US006695310B1

(12) United States Patent
Shiver

(10) Patent No.: US 6,695,310 B1
(45) Date of Patent: Feb. 24, 2004

(54) ENCLOSED PLAY AREA BALL GAME SPECTATOR'S GAME OF CHANCE

(76) Inventor: Carolyn M. Shiver, 818 W. Plaquemine St., Church Point, LA (US) 70525

( * ) Notice: Subject to any disclaimer, the term of this patent is extended or adjusted under 35 U.S.C. 154(b) by 0 days.

(21) Appl. No.: 10/225,653

(22) Filed: Aug. 21, 2002

(51) Int. Cl.[7] ..... A63F 3/06
(52) U.S. Cl. ..... 273/269
(58) Field of Search ..... 273/269, 139

(56) References Cited

U.S. PATENT DOCUMENTS

| | | | | | |
|---|---|---|---|---|---|
| 4,271,622 | A | * | 6/1981 | Tippmann et al. | 40/606 |
| 4,711,454 | A | * | 12/1987 | Small | 273/269 |
| 5,518,239 | A | * | 5/1996 | Johnston | 273/139 |
| 5,782,470 | A | * | 7/1998 | Langan | 273/139 |
| 6,045,466 | A | | 4/2000 | Suess | |
| 2002/0162256 | A1 | * | 11/2002 | Wardle et al. | 40/452 |

OTHER PUBLICATIONS http://www.mbfootball.com/sponsors.htm, Myrtle Beach Stingrays Indoor Football Sponsors, Mar. 21, 2002.*

* cited by examiner

*Primary Examiner*—William M. Pierce
(74) *Attorney, Agent, or Firm*—Jesse D. Lambert

(57) ABSTRACT

Game of chance for spectators at ball games conducted in enclosed play areas, particularly indoor football games. Around the playing area at the field level are a number of dasherboards, each with a given advertiser's logo thereon. Striking the dasherboards, by either a player's body who has gone out of bounds, or by a ball, generates a logo "strike" corresponding to the logo on that dasherboard. Over the course of a game, usually a number of such strikes occur. Spectators hold game cards bearing an arrangement of logos, similar to a conventional "bingo" card, and mark the logos on the card corresponding to the logo on a dasherboard which has been struck. Achieving some defined pattern of marked logos, or marking of even a single "bonus" logo, results in a prize for that spectator card holder.

13 Claims, 4 Drawing Sheets

GAME CARD

| | | | | |
|---|---|---|---|---|
| Logo 1 | Logo 6 | Logo 11 | Logo 16 | Logo 21 |
| Logo 2 | Logo 7 | Logo 12 | Logo 17 | Logo 22 |
| Logo 3 | Logo 8 | Logo 13 | Logo 18 | Logo 23 |
| Logo 4 | Logo 9 | Logo 14 | Logo 19 | Logo 24 |
| Logo 5 | Logo 10 | Logo 15 | Logo 20 | Logo 25 |

FIG. 3a

GAME CARD

| | | | | |
|---|---|---|---|---|
| Logo 1 | Logo 6 | Logo 11 | Logo 16 | ~~Logo 21~~ |
| Logo 2 | Logo 7 | Logo 12 | ~~Logo 17~~ | Logo 22 |
| Logo 3 | Logo 8 | ~~Logo 13~~ | Logo 18 | Logo 23 |
| Logo 4 | ~~Logo 9~~ | Logo 14 | Logo 19 | Logo 24 |
| ~~Logo 5~~ | Logo 10 | Logo 15 | Logo 20 | Logo 25 |

FIG. 3b

ENCLOSED PLAY AREA BALL GAME SPECTATOR'S GAME OF CHANCE

BACKGROUND

1. Field of Art

This invention relates to games of chance, and more particularly to a game of chance which is participated in by spectators at an enclosed play area ball game. The invention is particularly (although not exclusively) applicable to indoor football games played in enclosed playing areas or arenas.

2. Related Art

Sports played in enclosed play areas, in particular indoor football games, have become very popular spectator sports. While viewing of the games in and of themselves is the primary attraction for spectators, promoters of the games also stage other attractions for enhancing spectator attendance. Examples include light shows, cheerleading, music, entertaining videos on video display screens, and giving various prizes to the crowd. One way in which prizes are given away is simply to launch promotional items such as souvenir cups, T-shirts and the like into the audience, to be caught by the spectators.

The well known game of chance called "bingo" is extremely popular. Players hold one or more game cards, each card typically having a grid of a number of spaces or squares, each square corresponding to a certain letter/number combination. As a "caller" calls letter/number combinations (which are determined by chance, often by pulling balls inscribed with letter/number combinations at random from a hopper), the players mark the squares on their cards which match the called combinations. In a given sequence of play, the first player to achieve a complete row of marked squares on his or her card, whether horizontally, vertical, or diagonal, makes that player a winner. A variation of the common bingo game is one in which the play card squares are identified with unique characters instead of letter/number combinations, and the unique characters are somehow randomly selected and called out for the players to match up on their cards. Yet another variation is that a winner may be determined by only a single "bonus" square being picked, instead of or in addition to the full row winning requirement.

The present invention combines attractive aspects of ball games played in enclosed play areas, with a game of chance similar to bingo, for an attractive and novel game of chance for the spectators.

SUMMARY OF THE INVENTION

The present invention is a novel system and method for increased spectator participation and attraction at spectator sports. While the present invention is not limited to only a single sport, and not limited to games played indoor or outdoor, the present invention is especially suited to indoor professional football games. It is understood that the present invention could be incorporated into games played outdoors, and with other sports such as hockey, soccer, and basketball, as long as the game is staged in an enclosed play area (although not necessarily indoors). It is to be further understood for purposes of this application that the term "ball" refers more generally to playing pieces, and includes for example pucks used in hockey games. For illustrative purposes in this application, the invention will be described in conjunction with indoor football games. Such football games are staged in indoor, enclosed play areas, where the playing surface (that is, the field itself) is surrounded at, or relatively closely to, the field boundaries by upright panels, often abutting some part of the structure of the enclosed play area, such as in a stadium or arena. For purposes of this application, the panels will be referred to as "dasherboards." Since players often go out of bounds (whether intentionally, or unintentionally by being forced out by an opposing player during a play), the players during the course of a game will strike the dasherboards a number of times, which number of course is not predictable but generally happens with some frequency.

In addition to the players striking the dasherboards, thrown or kicked balls will periodically strike them.

In addition to the uncertainty or randomness in the number of times dasherboards are struck either by players or balls, it is readily understood that which of the dasherboards surrounding the field are struck during the course of a game is also random (albeit due to the basic nature of the game, dasherboards in certain areas over time will show a greater frequency of strikes than will other dasherboards).

The present invention advantageously uses each random strike on the dasherboards (both in number of strikes and which dasherboards are struck), each of the dasherboards having an advertisement of a given sponsor (which for purposes of this application, will be referred to as a "logo," although the logo may contain typed words only, stylized words, symbols, or any combination thereof) on it, to generate a series of logo "strikes." Spectators have one or more game cards similar to those used in a conventional bingo game, each of the cards having a grid made up of a number of spaces (typically, although not necessarily, squares), each square having an advertiser's unique logo. As the dasherboards are struck, the spectators mark off the square or squares on their game cards corresponding to the logo on the dasherboard which has been struck. In this manner, over the course of an indoor football game, the spectators are at the same time marking squares on their game cards, and the first spectator to complete a row (or some other pattern, or even to mark a single "bonus" strike) on his or her card wins a prize. The resulting game of chance is highly attractive to spectators and enhances spectator attendance and participation at indoor games. Various types of visual display mechanisms may be used to display for the crowd the logo of the dasherboard which was struck, in addition to an audio announcement (for example, by a live announcer) of each dasherboard strike and the corresponding logo. The visual display and audio announcement may be automatic, in the sense that a strike on a dasherboard automatically generates the display and announcement, or both may be controlled and the audio announcement made by a person. One or more statisticians keep a record of the strikes.

BRIEF DESCRIPTION OF THE DRAWINGS

FIGS. 3*a* and 3*b* are views of an exemplary game card, showing in FIG. 3*a* an unmarked card, and in FIG. 3*b* a card with a winning pattern (for example, a row) marked.

FIG. 3*c* is a flowchart showing the steps of the method of the present invention.

DESCRIPTION OF THE PRESENTLY PREFERRED EMBODIMENT

The present invention may take various embodiments, however for purposes of this application one of the presently preferred embodiments is described. It is understood that various changes can be made in the invention while remaining within the scope of the appended claims.

Figure 1:
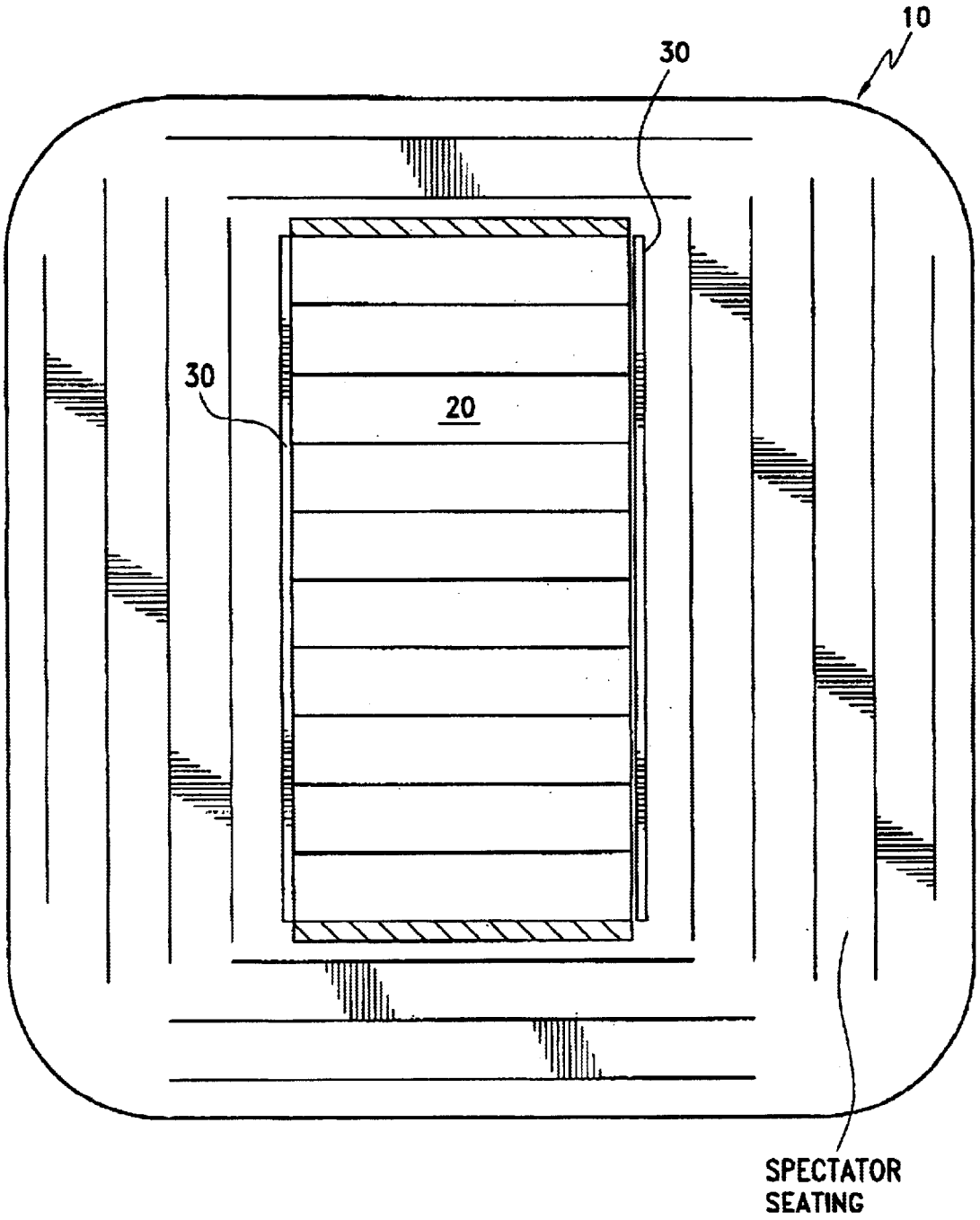
FIG. 1 is a plan (overhead) view of an exemplary enclosed play area, showing the dasherboards of the present invention.
Figure 2:
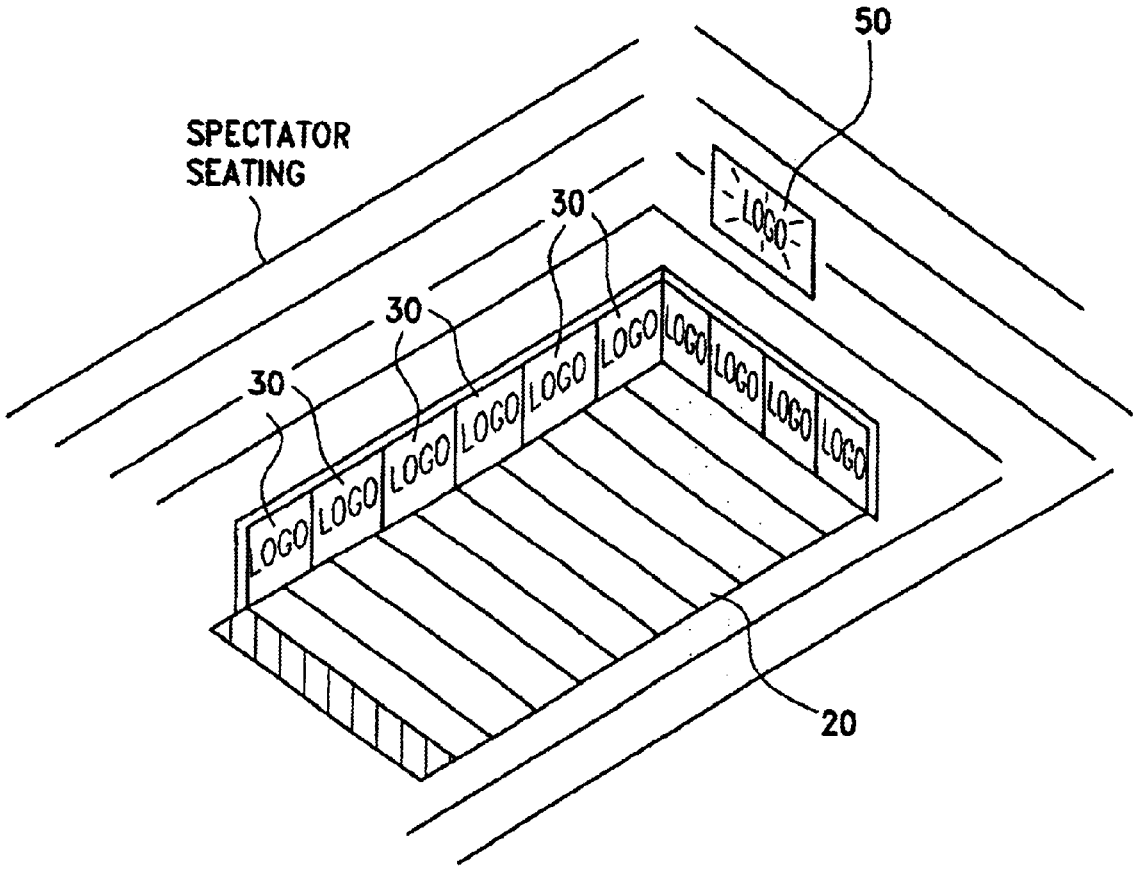
FIG. 2 is a perspective view of the enclosed play area of FIG. 1, showing a visual display for displaying the logo of a struck dasherboard (dasherboards on two of the sides of the field are omitted for clarity).

For illustrative purposes in this application, the system and method of the present invention will be described in conjunction with enclosed play area football games, such as indoor football games. As shown in the figures, the system comprises an enclosed play area 10, comprising a playing field 20 having defined boundaries, at least partially surrounded by a plurality of dasherboards 30. For example, depending upon exact layout of the play area, dasherboards 30 may be placed only on the sides of the playing field 20; or alternatively, may be placed completely around playing field 20. Dasherboards 30, depending upon the nature of the ball game being played and the exact layout of the field, may be at the boundaries of the field, or set back a short distance from the boundaries. If set back from the boundaries, the dasherboards are still close enough to be struck by players or balls going out of bounds during the game. FIG. 1 is an overhead view of an enclosed play area. FIG. 2 is a perspective view of the enclosed play area shown in FIG. 1, and for clarity omits the dasherboards on two sides of the playing field.

At least some, and preferably each, of dasherboards 30 comprises a logo 40 typically of an advertiser, such as a local company advertising its products and/or services. Logo 40 may be any combination of printed or stylized words or symbols identifying or relating to the advertiser. In one of the preferred embodiments, the system further comprises a visual display 50 of the logo which has been contacted on a given play of the game. Visual display 50 may be created manually (that is, in response to a signal from game personnel monitoring the dasherboard strikes) or may be an automated display responsive to contact or pressure on the dasherboard. In addition, the preferred embodiment of the system further comprises a means for generating an audio announcement, 60, of the logo on the dasherboard which has been struck. Said means for generating an audio announcement can be a live announcer, or can be an automated audio signal responsive to the strike or contact against the dasherboard.

During the course of the ball game, dasherboards are frequently struck, and in fact are struck on most plays of an indoor football game. As can be appreciated by a review of FIGS. 1 and 2, when a dasherboard is struck, a record is made of the logo on that dasherboard, and in the preferred embodiment both a visual display of that logo and an audio announcement is made. Despite the fact that some dasherboard (and often more than one) is often hit, a random collection of hits will result over the course of a game, as there is no pre-determined dasherboard to be hit on a given play. A statistician will keep a record of the dasherboard strikes.

At least some of the spectators watching the game have at least one game card 60, as shown in FIGS. 3 and 3*a*. Game card 60 has a number of logos printed thereon in some arrangement, often in a grid pattern. It is understood that any arrangement or pattern could be made on the game card; that is, the pattern is not confined to a rectangular pattern of columns and rows. As the ball game progresses and strikes are made against the dasherboards, the spectator will mark the logo(s) on his or her game card(s) which correspond to the logo on the struck dasherboard. In addition to the players striking the dasherboards, thrown or kicked balls will periodically strike them, and can also be counted as strikes. In addition to the uncertainty or randomness in the number of times dasherboards are struck either by players or balls, it is readily understood that which of the dasherboards surrounding the field are struck during the course of a game is also random (albeit due to the basic nature of the game, dasherboards in certain areas over time will show a greater frequency of strikes than will other dasherboards). Such uncertainty is attractive to those spectators enjoying games of chance. Once a defined pattern is marked on game card 60, such as a complete diagonal as in FIG. 3*a*, that game card holder is eligible for a prize. Alternatively, certain of the logos may be "bonus" logos, in that only a single logo need be marked to win a prize.

In addition to strikes generated by player and/or ball contact, during the course of the game an announcer at the ball game may also announce one or more logos as "wild card" or bonus strikes. By this, the spectators are entitled to mark the logos on their game cards corresponding to the announced bonus strikes, even though the corresponding dasherboard has not actually been struck.

It can be readily seen that an attractive game of chance results from the random dasherboard strikes and the resultant game card markings, which may result in a spectator being eligible for a prize. The resulting game of chance is highly attractive to spectators and enhances spectator attendance and participation at indoor games.

While the above description contains many specificities, it is understood that same are by way of example and not limitation to the scope of the invention. For example, the exact enclosed play area can be varied to suit different indoor and outdoor arenas. The invention is suitable for use for different sports, including but not limited to football, soccer, basketball, and hockey. Indoor and outdoor enclosed play areas can be used. Different combinations or patterns of logos can be established as winning combinations and patterns.

Therefore, the scope of the invention is not to be limited to the above-described embodiments, but only by the appended claims and their legal equivalents.

I claim:

1. A game of chance for spectators at a ball game, comprising:

a) an enclosed play area for playing a ball game, comprising a playing field at least partially surrounded by a plurality of dasherboards, at least some of said dasherboards bearing a logo;

b) a plurality of game cards adapted to be provided to spectators at said ball game, said game cards having an arrangement of logos thereon, each of said logos also present on at least one of said dasherboards, said game cards adapted to be marked to record said logos on said cards corresponding to the logo on a dasherboard which has been struck during the course of a game being played by a plurality of players with a ball, in said enclosed play area;

whereby a spectator holding a game card bearing a defined logo marking is eligible for a prize.

2. The game of chance of claim 1, further comprising a visual display of the logo on the dasherboard which has been struck.

3. The game of chance of claim 1, further comprising means for generating an audio announcement of the logo on the dasherboard which has been struck.

4. The game of chance of claim 2, further comprising means for generating an audio announcement of the logo on the dasherboard which has been struck.

5. The game of chance of claim 1, wherein said ball game is a football game.

6. The game of chance of claim 1, wherein said ball game is an indoor football game.

7. The game of chance of claim 1, wherein said ball game is an indoor soccer game.

8. The game of chance of claim 1, wherein said ball game is an indoor basketball game.

9. The game of chance of claim 1, wherein said ball game is an indoor hockey game.

10. The game of chance of claim 1, wherein said dasherboard strike is struck by a player.

11. The game of chance of claim 1, wherein said dasherboard strike is struck by a ball.

12. A method of playing a game of chance for spectators at an indoor ball game, comprising the steps of:

a) providing:

i) an enclosed indoor play area, comprising a playing field surrounded by a plurality of dasherboards, at least some of said dasherboards bearing a logo; and iii) a plurality of players capable of playing said ball game with a ball;

b) providing a plurality of game cards to spectators at said ball game, said game cards having an arrangement of logos thereon, each of said logos also present on at least one of said dasherboards, said game cards adapted to be marked to record said logos on said cards corresponding to the logo on a dasherboard which has been struck during the course of the game;

c) conducting said indoor ball game;

d) making visual displays and audio announcements of the logos on the dasherboards which have been struck; and e) during the course of said indoor ball game, having said spectators mark said game cards in spaces corresponding to the logos on said dasherboards which have been struck, whereby when one or more of said spectators marks a defined pattern of spaces, said one or more spectators wins a prize.

13. The method of claim 12, further comprising the step of random announcement of one or more logos corresponding to logos on said game cards, for marking thereon by said spectators, when said dasherboards bearing said logos have not been struck, thereby giving said spectators certain bonus marks.

* * * * *